US008430799B2

(12) United States Patent
Tussy

(10) Patent No.: US 8,430,799 B2
(45) Date of Patent: Apr. 30, 2013

(54) PHYSICAL TRAINING METHOD AND DEVICE

(76) Inventor: Kevin Alan Tussy, Las Vegas, NV (US)

( * ) Notice: Subject to any disclaimer, the term of this patent is extended or adjusted under 35 U.S.C. 154(b) by 46 days.

(21) Appl. No.: 12/928,707

(22) Filed: Dec. 17, 2010

(65) Prior Publication Data

US 2012/0157273 A1 Jun. 21, 2012

(51) Int. Cl.
*A63B 21/00* (2006.01)

(52) U.S. Cl.
USPC ..... 482/124; 482/125

(58) Field of Classification Search ..... 482/124
See application file for complete search history.

(56) References Cited

U.S. PATENT DOCUMENTS 5,752,900 A * 5/1998 Holland, Jr. ..... 482/124
7,147,590 B2 * 12/2006 Toven ..... 482/51

* cited by examiner

*Primary Examiner* — Jerome W. Donnelly

(57) ABSTRACT

An exercise device comprising a wrist band that can be secured to a user's wrist and a clearly marked indicator region on the inside portion of the wrist band, wherein the indicator region is approximately between 0.5 and 1.5 inches wide and is generally aligned with the point where the user's thumb and index finger meet. The wrist band may be part of a glove, and may be attached to the palm area of the glove and positioned such that it extends between the thumb and index finger of the user. The resistance band may secured to a point in the center of the user's back between the shoulder blades. A method of performing a resistance exercise wherein a user grasps one end of a resistance band in the palm of the user's hand such that the resistance band extends between the thumb and index finger of the user, across the user's arm below the shoulder, across the user's shoulder blade, and is secured to a point in the center of the user's back between the shoulder blades. The user extends the user's arm such that the user's hand moves from a point near the user's chin or chest to a point directly in front of the user such that the resistance band passes across an indicator region located on the inside portion of the user's wrist generally aligned with the point where the user's thumb and index finger meet.

3 Claims, 3 Drawing Sheets

PHYSICAL TRAINING METHOD AND DEVICE

BACKGROUND OF THE INVENTION

1. Field of the Invention

The invention relates generally to the field of physical training methods and devices. In particular, the invention relates to the use of resistance devices including resistance bands.

2. Description of Related Art

The prior art includes a variety of resistance training devices such as resistance bands and cable or strap-based resistance systems. However, the prior art has failed to disclose ways to insure that such systems are used in a manner that will maximize results. In addition, the prior art has failed to disclose a simple resistance band system that allows the user to confirm correct form in the performance of a variety of different resistance exercises.

SUMMARY OF THE INVENTION

An exercise device comprising a wrist band that can be secured to a user's wrist and a clearly marked indicator region on the inside portion of the wrist band, wherein the indicator region is approximately between 0.5 and 1.5 inches wide and is generally aligned with the point where the user's thumb and index finger meet. In various exemplary embodiments, the wrist band is part of a glove, and a resistance band is attached to the palm area of the glove and positioned such that the resistance band extends between the thumb and index finger of the user. In various exemplary embodiments, the resistance band is secured to a point in the center of the user's back between the shoulder blades.

A method of performing a resistance exercise wherein a user grasps one end of a resistance band in the palm of the user's hand such that the resistance band extends between the thumb and index finger of the user, across the user's arm below the shoulder, across the user's shoulder blade, and is secured to a point in the center of the user's back between the shoulder blades. The user extends the user's arm such that the user's hand moves from a point near the user's chin or chest to a point directly in front of the user such that the resistance band passes across an indicator region located on the inside portion of the user's wrist generally aligned with the point where the user's thumb and index finger meet.

DETAILED DESCRIPTION OF THE PREFERRED EMBODIMENTS

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Figure 1:
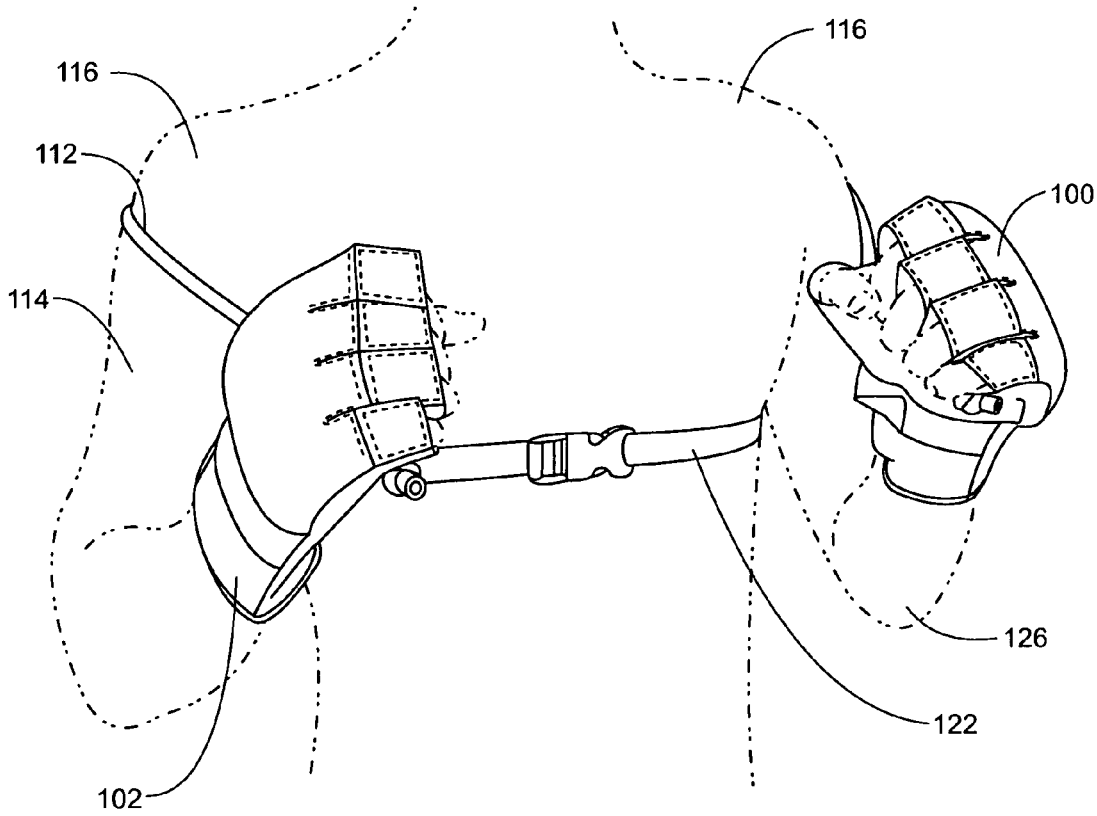
FIG. 1 is an illustration showing a front view of an exemplary physical training device in accordance with the invention on a user.
Figure 2:
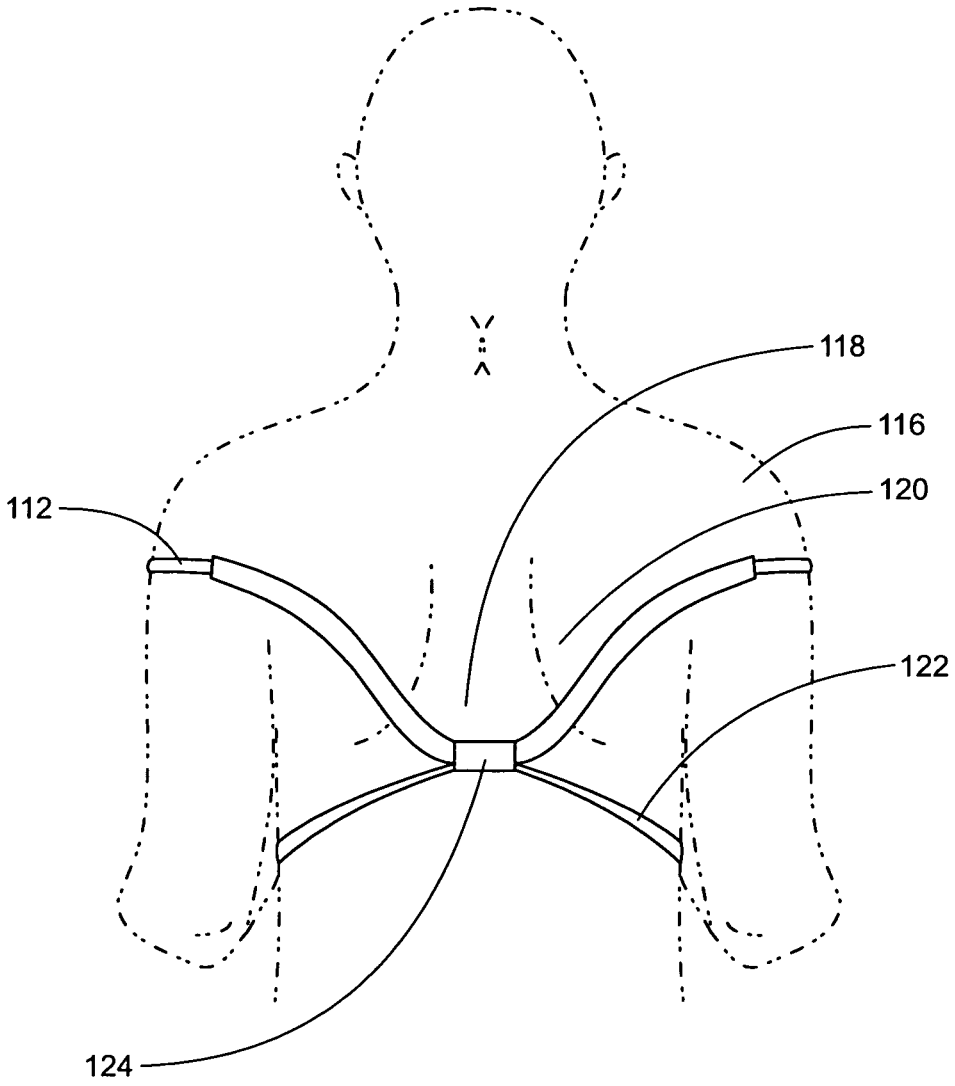
FIG. 2 is an illustration showing a back view of an exemplary physical training device in accordance with the invention on a user.
Figure 3:
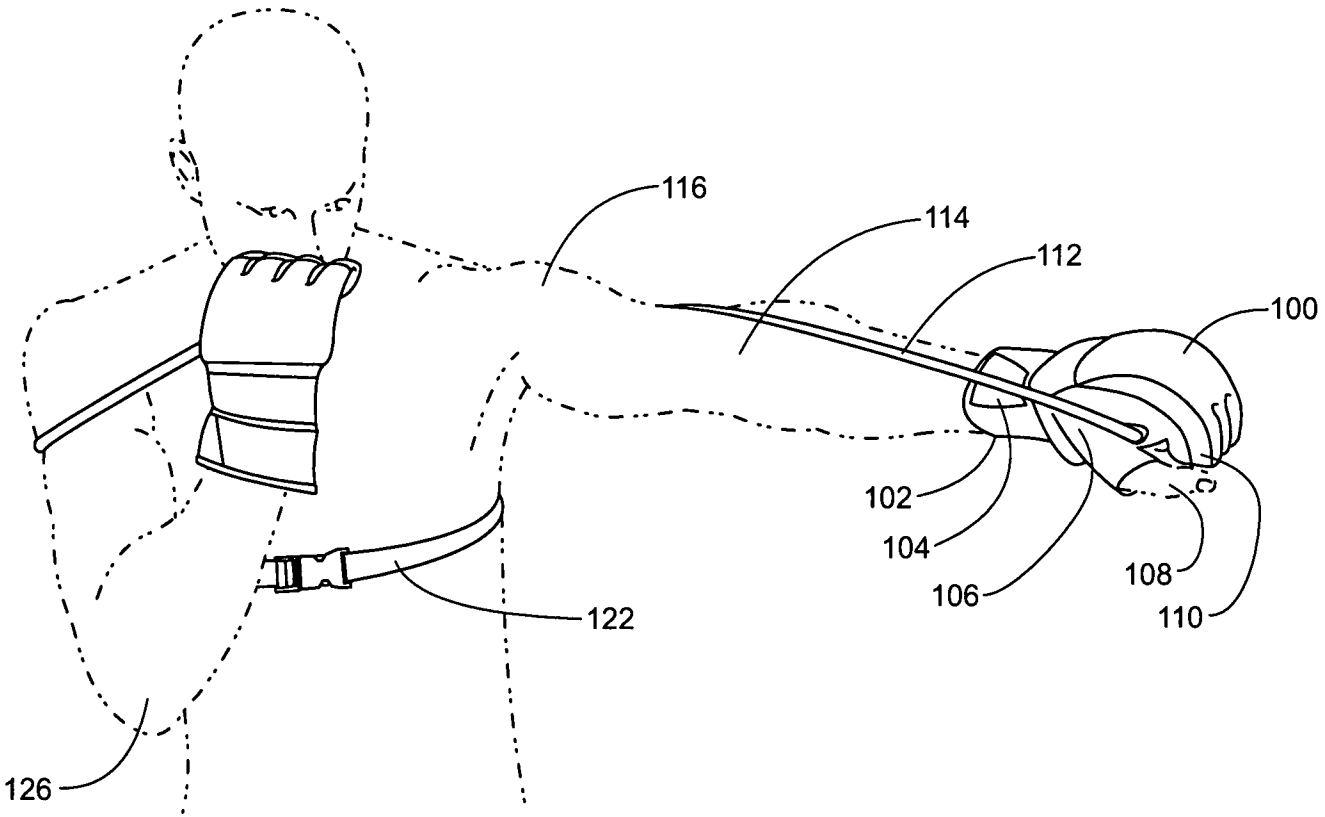
FIG. 3 is an illustration showing a front view of an exemplary physical training device in accordance with the invention on a user during use.

Referring to FIGS. 1-3, an exemplary embodiment of the invention consists of a glove 100 that fits over a user's hand similar to a boxing, training, or weight lifting glove. The glove 100 includes a wrist portion 102 that wraps around the user's wrist. The wrist portion 102 includes an indicator region 104 that is positioned on the inner side of the wrist approximately in line with the base 106 of the area between the user's thumb 108 and index finger 110. The indicator region 104 may be outlined or filled in a color or pattern that contrasts with the color of the wrist portion 102 so that it can be easily seen by the user. The indicator region is preferably between 0.5 and 1.5 inches in width.

The glove 100 can be used with a resistance band 112 attached to the glove 100 or grasped by the user. The resistance band 112 may attach to the glove 100 at a variety of points on or near the palm of the user's hand, or the user can grasp the resistance band in the palm of their hand. In one exemplary embodiment, the resistance band 112 attaches at the outside edge of the palm of the glove 100. The band crosses the user's palm then passes from the palm area, between the thumb 108 and index finger 110. This allows the hand to tighten and grip the band firmly so the glove does not twist or move out of place on the users hand. The band then crosses over the user's arm 114 below the shoulder 116 and around the user's back 118 across the area of the shoulder blade 120.

In an exemplary embodiment, the resistance band 112 is attached to a chest strap 122 in the center of the user's back. The resistance band 112 then continues across the user's other shoulder blade 120, around and across the user's other arm 114 below the shoulder 116, between the user's other thumb 108 and index finger 110 and across the user's other palm where it is similarly attached or grasped. The chest strap 122 extends around the front of the user's chest to provide a point of fixation 124 for the resistance band 112 on the user's back. This point of fixation 124 keeps the resistance band in the correct position even during a vigorous workout. The point of fixation 124 can be a loop or any similar connection, and may attach to a specific point on the resistance band or may allow the band to slide laterally without restriction. In an exemplary embodiment, the chest strap may be replaced with a harness or a garment that includes a loop or other device for providing such a point of fixation 124. The chest strap may include a variety of physical monitoring devices such as heart rate monitors or other similar devices.

The inventive device can be used for a variety of resistance exercises. In one such exemplary method shown in FIGS. 1-3, the user stands with her elbows 126 close to her body and her arms 114 bent such that her hands are near her chest or chin. The user then extends one or both arms 114 forward in a punching motion. If the punch is performed correctly with the user's hand extending in the correct position, at full extension of the arm 114 the resistance band 112 will pass across the indictor region 104 on the wrist portion 102 of the glove 100 as illustrated in FIG. 3. This provides a clear indication to the user that the punch has been performed correctly. If the punch is not performed correctly, the band will not cross the indicator region 104, providing immediate feedback to the user that the punch was not performed correctly.

In an exemplary embodiment of the invention, an alternative resistance device such as a cable and pulley based weight system is used instead of a resistance band 112. The user grasps the handle or end of this alternative resistance device in the same matter as resistance band 112, or attaches it to the glove 100. The user then positions their torso such that the cable or other strap passes from their palm, between the thumb 108 and index finger 110, across the user's arm 114 below the shoulder 116, and around the user's back 118 across the area of the shoulder blade 120. The user can then perform the same punching motion as described above, such that the cable passes across the indicator region 104 when the exercise is performed correctly.

Other exercises can be performed using a similar method. For example, in one exemplary method the user performs a standard push-up using the glove 100 and resistance band 112 as described above. When the user pushes up to the position with their arms fully extended, the band will extend across the indicator region 104 if the push-up is being performed correctly.

It will be readily understood that a complete glove 100 with an integrated wrist portion 102 is not essential to the invention. The glove 100 and wrist band 102 may be separate articles, or the indicator region 104 may be formed on a wrist band or other device that is secured to the hand or wrist area. The glove 100 may be any type of glove or other article for affixing the resistance band 112 or other device to the user's hand.

In another exemplary embodiment, a video game or similar controller is attached to the resistance band 112, integrated into the glove 100, or otherwise held by the user. Such controller may include an accelerometer, a gyroscope, and/or other means for providing information regarding the relative movement of the user's hand to a video gaming or similar device. In another exemplary embodiment, the glove 100 includes a pocket, pouch, strap, or similar structure to attach a video game or similar controller. In another exemplary embodiment, the glove 100 includes reflective patches, lights, or other devices that can be used to capture the motion of the user's hand. These various embodiments allow the user to train using the device described herein in connection with a video game, simulation, or training program.

What is claimed is:

1. An exercise device comprising:

a wrist band that can be secured to a user's wrist; and a clearly marked indicator region on the inside portion of the wrist band, wherein the indicator region is approximately between 0.5 and 1.5 inches wide and is located on the inner side of the user's wrist generally aligned with the area between the user's thumb and index finger on the back of the hand, wherein said wrist band is part of a glove; and wherein a resistance band is attached to the palm area of the glove and positioned such that the resistance band extends between the thumb and index finger of the user such that when a user extends their arms in a proper punching motion the resistance band will pass across the indicator regions to indicate that the punch was performed correctly.

2. The device of claim 1, wherein said resistance band is secured to a point in the center of the user's back between the shoulder blades.

3. A method of performing a resistance exercise wherein:

a user grasps one end of a resistance band in the palm of the user's hand such that the resistance band extends between the thumb and index finger of the user, across the user's arm below the shoulder, across the user's shoulder blade, and is secured to a point in the center of the user's back between the shoulder blades;

the user extends the user's arm such that the user's hand moves from a point near the user's chin or chest to a point directly in front of the user such that the resistance band passes across an indicator region located on the inside portion of the user's wrist generally aligned with the point where the user's thumb and index finger meet.

* * * * *